US006736340B1

(12) United States Patent
Wang

(10) Patent No.: US 6,736,340 B1
(45) Date of Patent: May 18, 2004

(54) CONTROLLING DEVICE FOR A SPRINKLER

(76) Inventor: Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 0 days.

(21) Appl. No.: 10/445,929

(22) Filed: May 28, 2003

(51) Int. Cl.[7] ..... B05B 1/30; B05B 1/14; B05B 1/20; B05B 3/16; A62C 2/08

(52) U.S. Cl. ..... 239/583; 239/548; 239/551; 239/566; 239/242

(58) Field of Search ..... 239/583, 548, 239/551, 566, 242, 550, 556, 557, 436, 442, 443, 444; 251/319; 137/883

(56) References Cited

U.S. PATENT DOCUMENTS 3,423,024 A * 1/1969 Morawetz ..... 239/242
5,350,115 A * 9/1994 Burnworth et al. ..... 239/242
5,657,928 A * 8/1997 Jian ..... 239/242
6,478,241 B1 * 11/2002 Guo ..... 239/562

* cited by examiner

*Primary Examiner*—Michael Mar
*Assistant Examiner*—Darren Gorman
(74) *Attorney, Agent, or Firm*—Bacon & Thomas, PLLC

(57) ABSTRACT

A controlling device for a sprinkler includes multiple seals detachably received in the tube in a watertight manner. Each seal has outlets defined in a top face of the seal and passages defined to respectively communicate with a corresponding one of the outlets. Multiple controlling rods are linearly and movably received in the tube to engage with a bottom face of the seals so as to selectively block the communication between the passage and the outlets such that water inside the tube is controlled to be sprinkled out of the tube.

20 Claims, 4 Drawing Sheets

CONTROLLING DEVICE FOR A SPRINKLER

BACKGROUND OF THE INVENTION

1. Field of the Invention

The present invention relates to a controlling device, and more particularly to a controlling device for a sprinkler to control water flow out of the sprinkler via movement of controlling rods such that the sprinkler is able to control the area to be sprinkled.

2. Description of Related Art

Conventional sprinklers for watering the lawn have different functions beside sprinkling water on the lawn. Patents concerning how the sprinklers are controlled and how the water flow angle is changed are numerous. Some use water pressure to push the movement of a rotating plate so that the gradual rotation of the rotating plate is able to change the water sprinkling angle to water different areas on the lawn. Some even apply complex gear driven devices in the sprinkler to control the water output and the water sprinkling angle. No matter how complex or how complicated the sprinkler is, there is one thing for all the sprinklers in common, that is, the sprinkler has a tube for connecting to a water source and to receive therein water and an angle controlling device for controlling the water sprinkling angle. The angle controlling device indeed fulfills the users needs despite the structural differences. However, the controlling device inside the sprinkler may not serve the intended purpose once there is a malfunction. That is, due to the complexity tendency of the structure of the modern controlling device inside the sprinkler, maintenance to the defected controlling is becoming harder than ever and the time required to fix the problem takes much longer than before. During the maintenance period, there is nothing for the user to do. All the user can do is sit and wait.

To overcome the shortcomings, the present invention tends to provide an improved controlling device to mitigate the aforementioned problems.

SUMMARY OF THE INVENTION

The primary objective of the present invention is to provide an improved controlling device with which the user is able to easily control the water output from the sprinkler.

Another objective of the present invention is to provide a cover to securely sandwich seals with the tube, such that during operation of the sprinkler, the seals are connected to the tube in a watertight manner.

To achieve the foregoing objectives, the controlling device of the present invention has multiple controlling rods movably received in the tube and each having a neck formed on a mediate portion of the controlling rod and seals detachably connected to the tube in a watertight manner. Therefore, movement of the controlling rods enables the alignment and communication between the necks of the controlling rods and the passages defined in the seals to allow the water inside the tube to flow out of the sprinkler.

Other objects, advantages and novel features of the invention will become more apparent from the following detailed description when taken in conjunction with the accompanying drawings.

DETAILED DESCRIPTION OF THE PREFERRED EMBODIMENT

Figure 1:
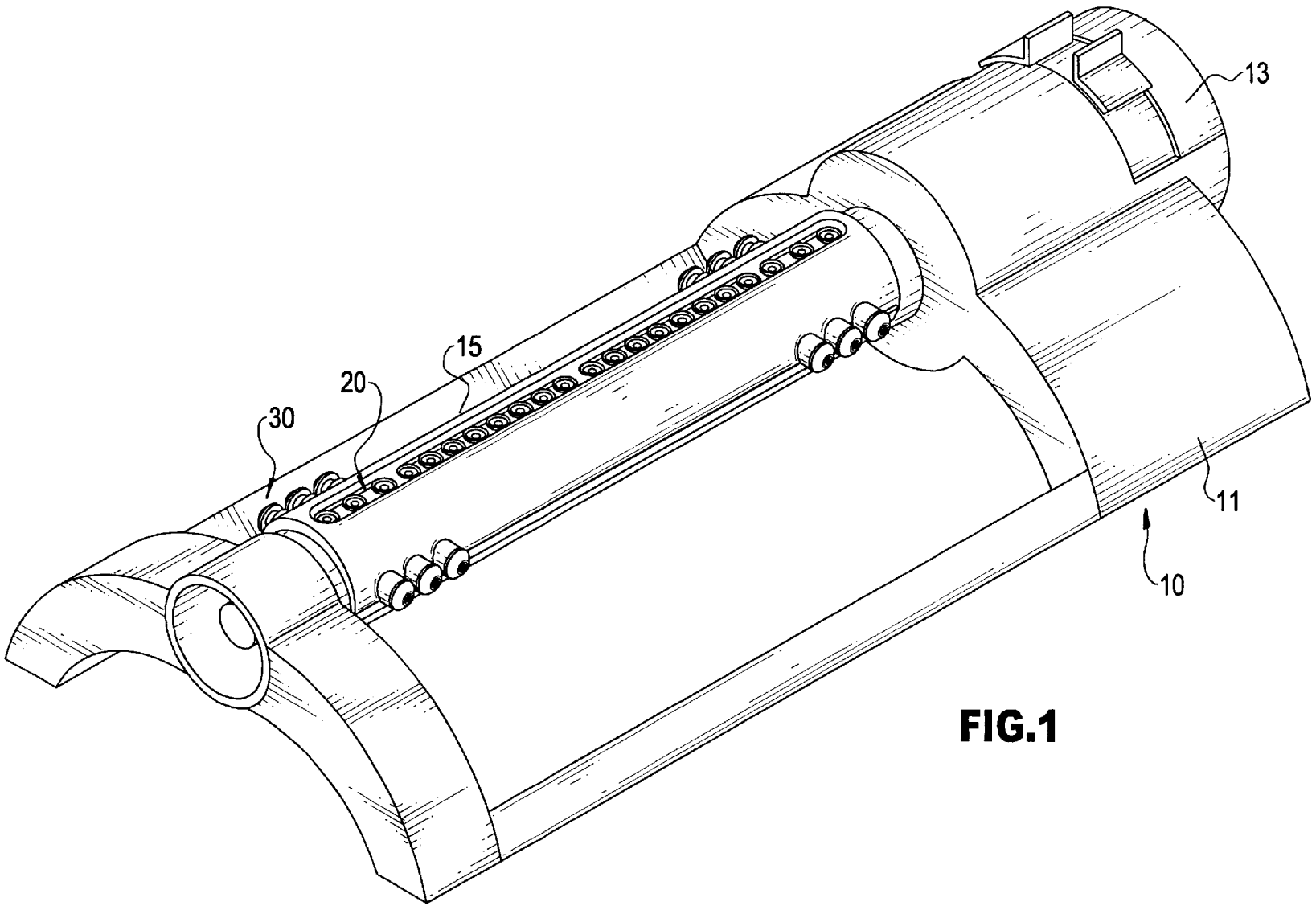
FIG. 1 is a perspective view of a sprinkler with a controlling device of the present invention.

With reference to FIG. 1, a sprinkler (10) has a bracket (11) to be placed on a plan surface, i.e. a lawn, and an angle adjusting device (13) mounted on a side of the sprinkler (10) to allow the sprinkled water out of the sprinkler (10) to change to different areas. Because the operation and purpose of the angle adjusting device (13) are not the focus of the present invention, detailed description thereof is thus omitted.

The controlling device in accordance with the present invention has a tube (15), multiple seals (20) and multiple controlling rods (30).

Figure 2:
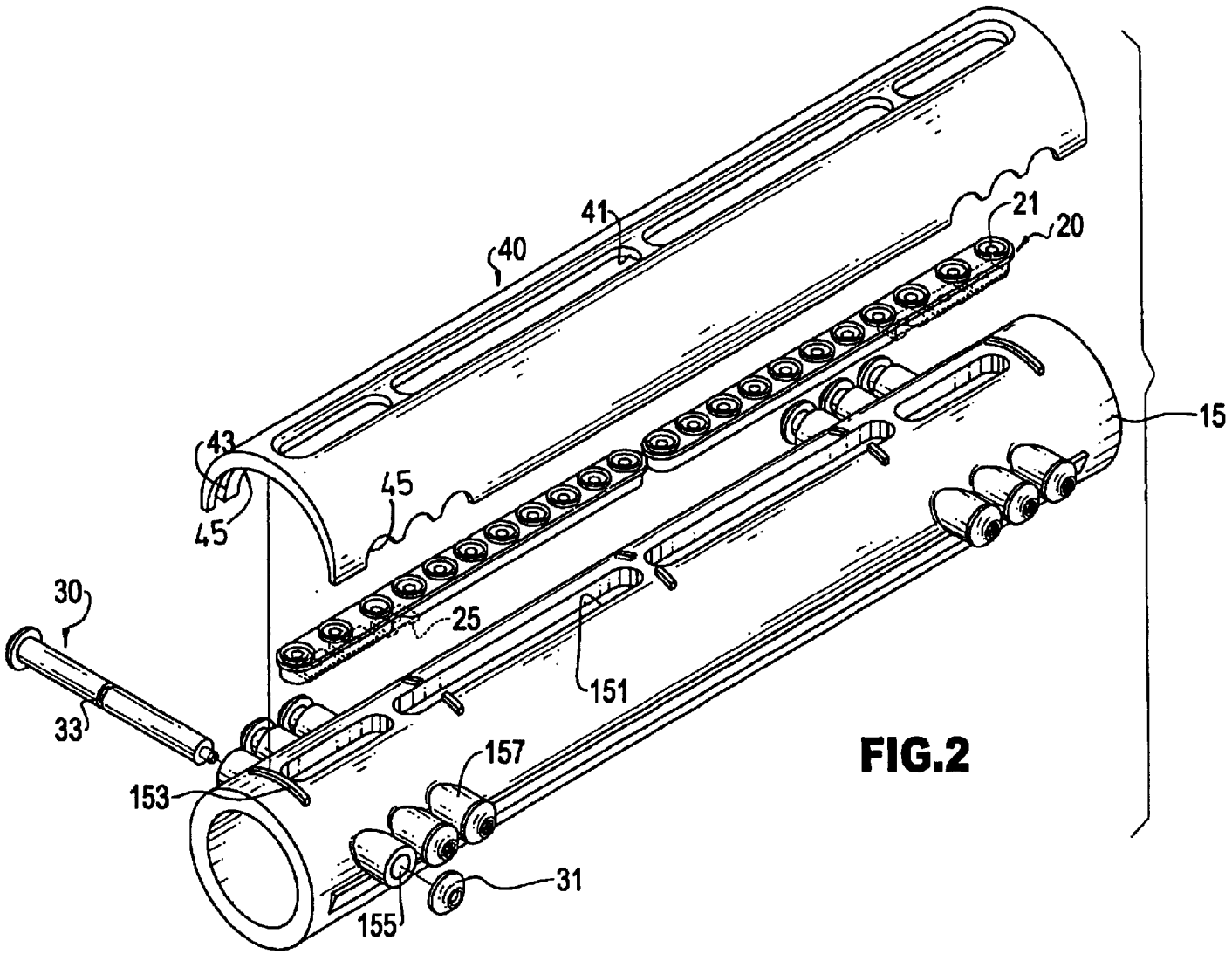
FIG. 2 is an exploded perspective view of the controlling device of the present invention.

With reference to FIG. 2, the tube (15) has two open ends one open end of which is adapted to connect to a water source via the angle adjusting device (13) and the other open end of which is closed by a cap (not shown). The tube (15) has through holes (151) defined through a periphery of the tube (15), connection ribs (153) formed adjacent to the through holes (151), multiple pairs of controlling holes (155) defined through the tube (15) in an orientation perpendicular to that of the through holes (151) and multiple pairs of flanges (157) formed with the tube (15) and each pair of flanges (157) aligned with and corresponding to one pair of controlling holes (155).

Figure 5:
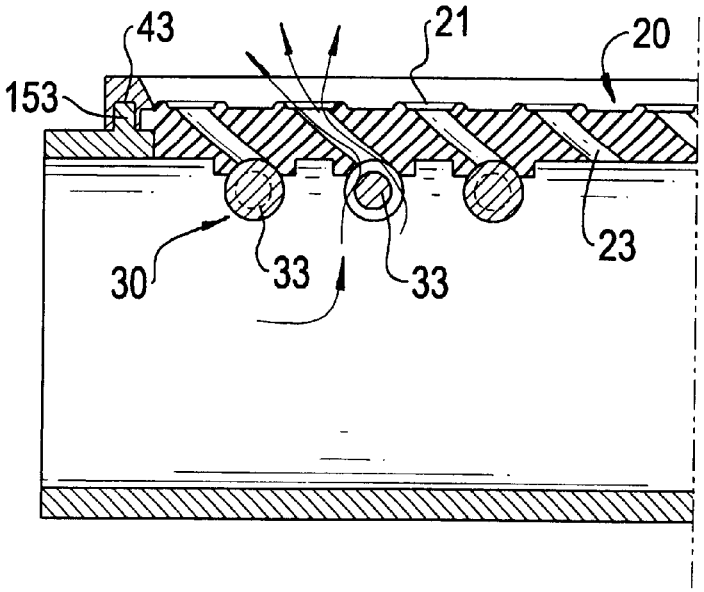
FIG. 5 is a partial cross sectional view showing the communication between the interior of the tube and the passage of the seal due to the actuation of the controlling rod as shown in FIG. 4.

The seals (20) are detachably received in the through holes (151) so that each seal (20) is received in a corresponding one of the through holes (151). Each seal (20) is made of a resilient material, such as rubber, and has multiple outlets (21) defined in a top face of the seal (20), passages (23) (as shown in FIG. 5) defined in the seal (20) and each passage (23) communicating with a corresponding one of the outlets (21) and saddles (25) made of soft material and formed on a bottom face of the seal (20) on two distal portions of the seal (20).

The controlling rod (30) has two heads (31) formed on two distal ends of the controlling rod (30), wherein one head (31) is detachably connected to a body of the controlling rod (30) and a neck (33) formed on a mediate portion of the controlling rod body.

In a preferred embodiment of the present invention, the controlling device of the present invention further has a cover (40) securely connected to the tube (15) and including holes (41) defined through a periphery of the cover (40) to correspond to the through holes (151) of the tube (15) and recesses (43) defined in a bottom face of the cover (40) to correspond to connection ribs (153) formed on the tube (15). Multiple pairs of cutouts (45) are defined in opposite sides of the cover (40) to correspond to the pairs of flanges (157) of the tube (15).

When the controlling device of the present invention is in assembly, the controlling rods (30) extend into the tube (15) from one side of the tube (15) and out of the tube (15) from the other side after removing one of the heads (31). To allow the controlling rods (30) to be freely movable inside the tube (15), the controlling rod (30) has a length longer than a diameter of the tube (15) plus thickness of a pair of flanges (157) on opposite sides of the tube (15). Furthermore, the head (31) has a diameter larger than that of the corresponding controlling hole (155) such that after the head (31) is connected to the controlling rod body, the controlling rods (30) are retained inside the tube (15).

Thereafter the seals (20) are respectively received in the corresponding through holes (151) of the tube (15) in a watertight manner with the saddles (25) respectively engaged with a corresponding one of the controlling rod bodies. As mentioned earlier, the cover (40) is applied to enhance the watertight connection between the tube (15) and the seals (20). After the cover (40) is placed on top of the tube (15) with the recesses (43) corresponding to the connection ribs (153) and the holes (41) corresponding to the through holes (151), ultrasonic is used to securely engage the connection ribs (153) in the corresponding recesses (43) such that the watertight connection of the seals (20) to the tube (15) is enhanced.

Figure 3:
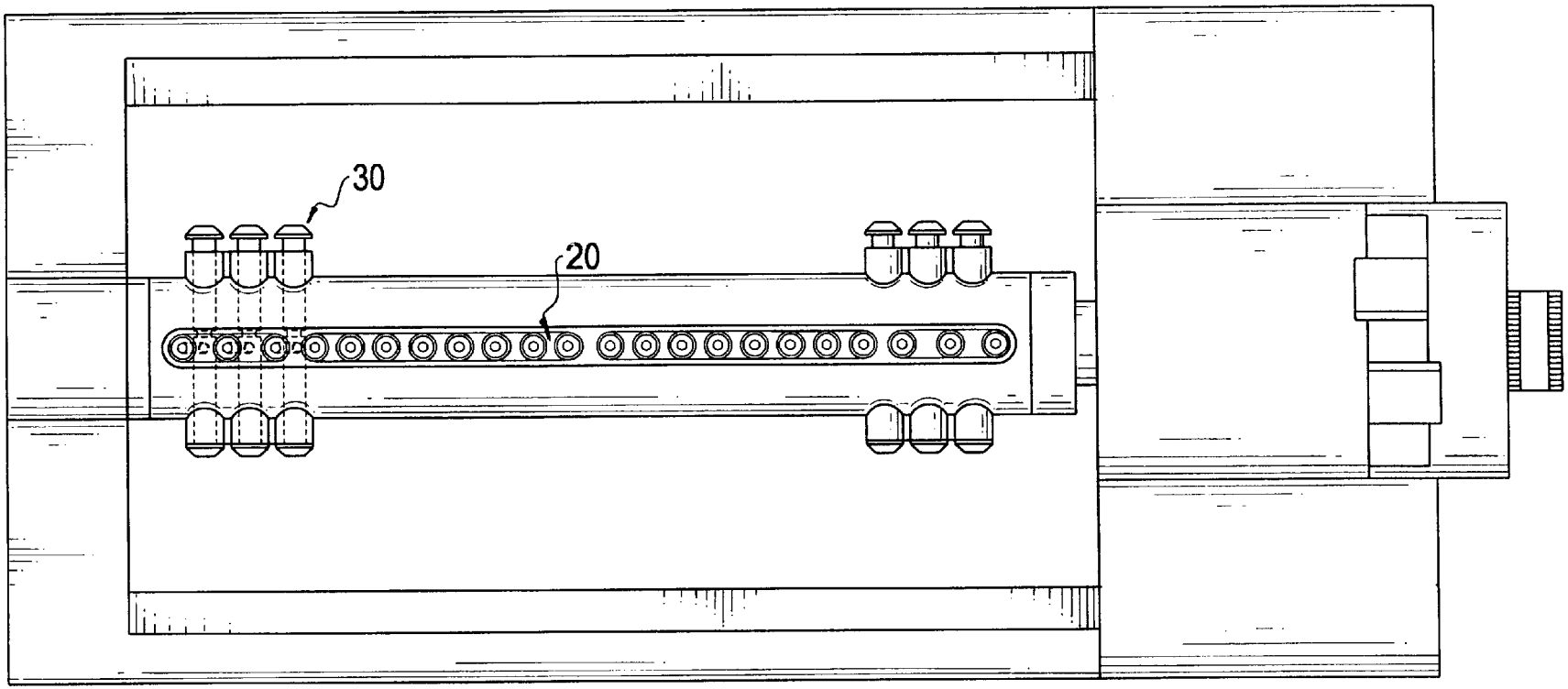
FIG. 3 is a top plan view showing that the controlling rods are not actuated.

With reference to FIG. 3, it is noted that before the actuation of the controlling rods (30), all the controlling rods (30) are at the same position. Meanwhile, the outlets (21) of the seals (20) are blocked by the controlling rods (30) so that water inside the tube (15) from the water source is retained inside the tube (15). As far as how the water inside the tube (15) sprinkles out of the tube (15), the actuation of the controlling rods (30) will be described in the following paragraphs.

Figure 4:
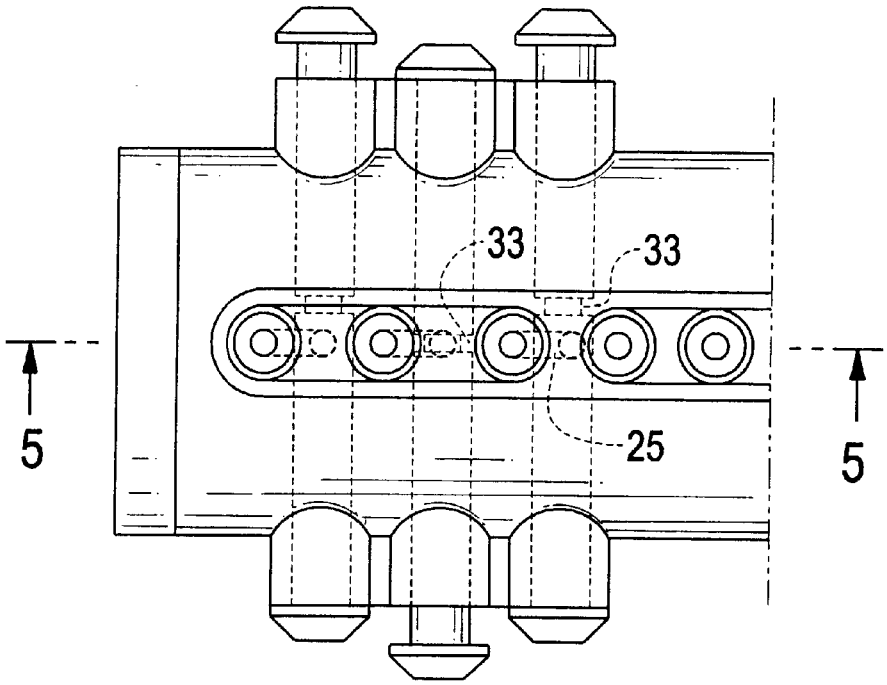
FIG. 4 is a partial top plan view showing the actuation of the controlling rod communicates the neck on the controlling rod with the outlet on top of the seal.

With reference to FIGS. 4 and 5, pushing the controlling rod (30) from one side of the tube (15) toward the other side of the tube (15) allows the neck (33) to align with a corresponding one of the passages (33) in the seal (20), such that water is able to be injected out from a corresponding one of the outlets (21). If the controlling rod (30) is not pushed, the controlling rod body engages with a corresponding one of the saddles (25) to block the corresponding passage (23) so that the water is not able to be injected out of the sprinkler (10) from the corresponding outlet (21).

Therefore, it is noted that whether the water is able to be injected out of the sprinkler is determined by the movement of the controlling rods (30). That is, the movement of the controlling rods (30) allows the necks (33) to align with the passages (23) such that water inside the tube (15) is sprinkled out of the tube (15) from the outlets (21).

Because whether the water is sprinkled out of the sprinkler is determined by the linear movement of the controlling rods (30), the operation is simple and quantity of the related elements is minimum such that even if there is a malfunction, the duration for maintenance is short. Again, due the simple structure, the cost for the sprinkler is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A controlling device for a sprinkler having a tube with one open end for connection with a water source, the controlling device comprising:

multiple seals adapted to be detachably received in through holes in the tube in a watertight manner, each seal having outlets defined in a top face of the seal, saddles formed on a bottom face of the seal and passages defined to respectively communicate with a corresponding one of the outlets; and multiple controlling rods adapted to be linearly and movably received in the tube to engage with a corresponding one of the saddles of the seals to selectively block the communication between the passage and the outlets such that water inside the tube is controlled to be sprinkled out of the tube.

2. The controlling device as claimed in claim 1, wherein each controlling rod has a neck defined in a mediate portion of the controlling rod such that when the neck is aligned with one of the passages, water is able to be sprinkled out of the tube.

3. The controlling device as claimed in claim 1 further comprising a cover adapted to be securely connected to the tube so that the seals are securely sandwiched between the cover and the tube.

4. The controlling device as claimed in claim 2 further comprising a cover adapted to be securely connected to the tube so that the seals are securely sandwiched between the cover and the tube.

5. The controlling device as claimed in claim 1, wherein each controlling rod has two heads and one of the two heads is detachably connected to a distal end of the controlling rod.

6. The controlling device as claimed in claim 2, wherein each controlling rod has two heads and one of the two heads is detachably connected to a distal end of the controlling rod.

7. The controlling device as claimed in claim 4, wherein each controlling rod has two heads and one of the two heads is detachably connected to a distal end of the controlling rod.

8. The controlling device as claimed in claim 7, wherein the seal is made of a resilient material.

9. A controlling device for a sprinkler, the controlling device comprising:

a tube with one open end for connection to a water source and through holes defined through a periphery of the tube;

multiple seals detachably received in the through holes in the tube in a watertight manner, each seal having outlets defined in a top face of the seal; and multiple controlling rods linearly and movably received in the tube to engage with a bottom face of the seals so as to selectively block the outlets such that water inside the tube is controlled to be sprinkled out of the tube from the outlets.

10. The controlling device as claimed in claim 9, wherein each controlling rod has a neck defined in a mediate portion of the controlling rod such that when the neck is aligned with one of the outlets, water is able to be sprinkled out of the tube.

11. The controlling device as claimed in claim 10 further comprising a cover securely connected to the tube so that the seals are securely sandwiched between the cover and the tube.

12. The controlling device as claimed in claim 9, wherein each seal further has passages defined in the seal, each passage arranged to respectively communicate with a corresponding one of the outlets and saddles formed on a bottom face of the seal such that each controlling rod is engaged with a corresponding one of the saddles.

13. The controlling device as claimed in claim 10, wherein each seal further has passages defined in the seal, each passage arranged to respectively communicate with a corresponding one of the outlets and saddles formed on a bottom face of the seal such that each controlling rod is engaged with a corresponding one of the saddles and the neck is able to selectively block the communication between the passage and the outlet.

14. The controlling device as claimed in claim 9, wherein each controlling rod has two heads and one of the two heads is detachably connected to a distal end of the controlling rod.

15. The controlling device as claimed in claim 12, wherein each controlling rod has two heads and one of the two heads is detachably connected to a distal end of the controlling rod.

16. The controlling device as claimed in claim 9, wherein the tube has multiple pairs of controlling holes defined in opposite sides of the tube and flanges each correspond to one of the pairs of the controlling holes, each controlling rod extends into the corresponding flanges and controlling holes and is movably received in the controlling holes.

17. The controlling device as claimed in claim 11, wherein the tube has multiple pairs of controlling holes defined in opposite sides of the tube and flanges each correspond to one of the pairs of the controlling holes, each controlling rod extends into the corresponding flanges and controlling holes and is movably received in the controlling holes.

18. The controlling device as claimed in claim 13, wherein the tube has multiple pairs of controlling holes defined in opposite sides of the tube and flanges each correspond to one of the pairs of the controlling holes, each controlling rod extends into the corresponding flanges and controlling holes and is movably received in the controlling holes.

19. The controlling device as claimed in claim 15, wherein the tube has multiple pairs of controlling holes defined in opposite sides of the tube and flanges each correspond to one of the pairs of the controlling holes, each controlling rod extends into the corresponding flanges and controlling holes and is movably received in the controlling holes.

20. The controlling device as claimed in claim 19, wherein the seal is made of a resilient material.

* * * * *